United States Patent [19]

Jambry et al.

[11] 4,332,681

[45] Jun. 1, 1982

[54] JUNCTION AND CONNECTION TERMINAL FOR THE SERVICE OF FIXED OR MOBILE PREMISES IN PARTICULAR FOR THE SUPPLY OF A SANITARY UNIT WHICH MAY BE ITSELF ATTACHED TO A CARAVAN OR A CAMPING-CAR

[76] Inventors: Jean-Francois Jambry, 17 Boulevard Raspail, 75007 Paris; Dusica Milojevic, 93 Boulevard Raspail, 75006 Paris, both of France

[21] Appl. No.: 144,255

[22] Filed: Apr. 28, 1980

[51] Int. Cl.[3] ..... C02C 1/00

[52] U.S. Cl. ..... 210/170; 52/34; 52/169.2; 137/236 R; 137/899; 210/532.2

[58] Field of Search ..... 210/748, 919, 920, 170, 210/532.2; 52/169.1, 169.2, 169.5, 169.6, 169.9, 34, 27, 35; 137/236 A, 899, 363, 345, 899.1

[56] References Cited

U.S. PATENT DOCUMENTS

| | | | |
|---|---|---|---|
| 2,840,101 | 6/1958 | Saylor | 137/899 X |
| 3,477,949 | 11/1969 | Lilendahl | 210/920 X |
| 3,543,294 | 11/1970 | Boester | 210/170 X |
| 3,568,838 | 3/1971 | Appelgren et al. | 210/170 X |
| 3,607,735 | 9/1971 | Hover et al. | 210/170 X |
| 3,620,246 | 11/1971 | Shoquist | 52/34 |
| 3,623,500 | 11/1971 | Hoy | 137/899 |
| 3,666,106 | 5/1972 | Green | 210/748 |
| 3,703,960 | 11/1972 | Kennedy | 210/170 X |
| 3,708,931 | 1/1973 | Button | 52/169.2 |
| 3,727,753 | 4/1973 | Starr | 52/34 |
| 3,811,462 | 5/1974 | Feliz | 137/899 |
| 3,875,056 | 4/1975 | Inglin | 210/532.2 |
| 4,002,561 | 1/1977 | Travease | 210/532.2 |
| 4,224,155 | 9/1980 | Milne | 210/170 X |
| 4,228,006 | 10/1980 | Hanna | 210/170 X |

*Primary Examiner*—John Adee
*Attorney, Agent, or Firm*—Kenyon & Kenyon

[57] ABSTRACT

A junction and connection terminal between, on one hand, a drinking water mains and an electric mains and, on the other hand, a fixed or mobile sanitary unit. This terminal also ensures the connection between this unit and a system for discharging sewage liquids and household waste liquids. The terminal comprises a unit of a strong material comprising two compartments the main compartment of which is buried in the ground but is flush with the surface of the ground. The other compartment projects from the ground. The terminal unit is provided with rapid couplings for its connection with the sanitary unit which is provided with complementary couplings. The terminal unit groups in its lower compartment, a system for discharging sewage liquids and the household waste liquids and, in its upper part, the drinking water mains and the electric mains.

15 Claims, 9 Drawing Figures

JUNCTION AND CONNECTION TERMINAL FOR THE SERVICE OF FIXED OR MOBILE PREMISES IN PARTICULAR FOR THE SUPPLY OF A SANITARY UNIT WHICH MAY BE ITSELF ATTACHED TO A CARAVAN OR A CAMPING-CAR

The invention relates to a junction and connection terminal between a mains supplying drinking water and a low-tension electric mains and a fixed or mobile sanitary unit, this terminal also ensuring the connections between this unit and a system for discharging sewage-liquids and household waste liquids.

In organized camps, and in particular on camping grounds, at the present time, there is provided only a collective sanitary equipment, sometimes of rudimentary type. The situation is practically the same on building sites and even also in certain rural schools which are not always provided with equipment of the desired quality and in the desired amount.

The object of the present invention is to overcome this situation and to provide collectivities, whether it concerns specifically camping grounds, building sites or schools, with mobile sanitary units which may be easily connected to a service terminal which is also part of the invention.

The feature of the service terminal is that it groups in a compact assembly all the means for supplying drinking water and electricity and for discharging waste liquids so as to be capable of providing service to a sanitary unit which may be employed as such or be complementary to a caravan or a camping-car which does not have such sanitary means.

The invention consequently provides essentially a junction and connection terminal between, on one hand, a mains supplying drinking water and an electric mains and, on the other hand, a fixed or mobile sanitary unit, said terminal also ensuring the connections between said unit and a system discharging sewage liquids and household waste liquids, said terminal comprising a unit of strong material forming two compartments, the main compartment of which is buried in the ground but is flush with the latter whereas the other compartment forms the projecting part of the terminal, said unit being provided with rapid couplings for its connection with the sanitary unit which is provided with complementary couplings, said terminal unit grouping in its lower compartment the system discharging the sewage liquids and the household waste liquids and in its upper part, the drinking water supply mains and the electric mains.

In one embodiment, the two compartments have a substantially parallel-sided shape and form an L-shape assembly whose horizontal branch is buried in the ground whereas the vertical branch projects from the ground and is fixed to the horizontal branch.

According to a feature of the invention, the sanitary unit connected to said terminal comprises a first enclosure enclosing equipment such as the lavatory pan, the washbasin and the shower, and a second enclosure forming a kitchenette, wherein the sanitary unit comprises on one of its front sides an opening surrounded by a movable and extensible passageway capable of ensuring the junction with a dwelling, the various systems of the sanitary unit being connected to the junction terminal which is capable of fitting into said unit.

Further features and advantages of the invention will be apparent from the ensuing description and the accompanying drawings in which.

Figure 1:
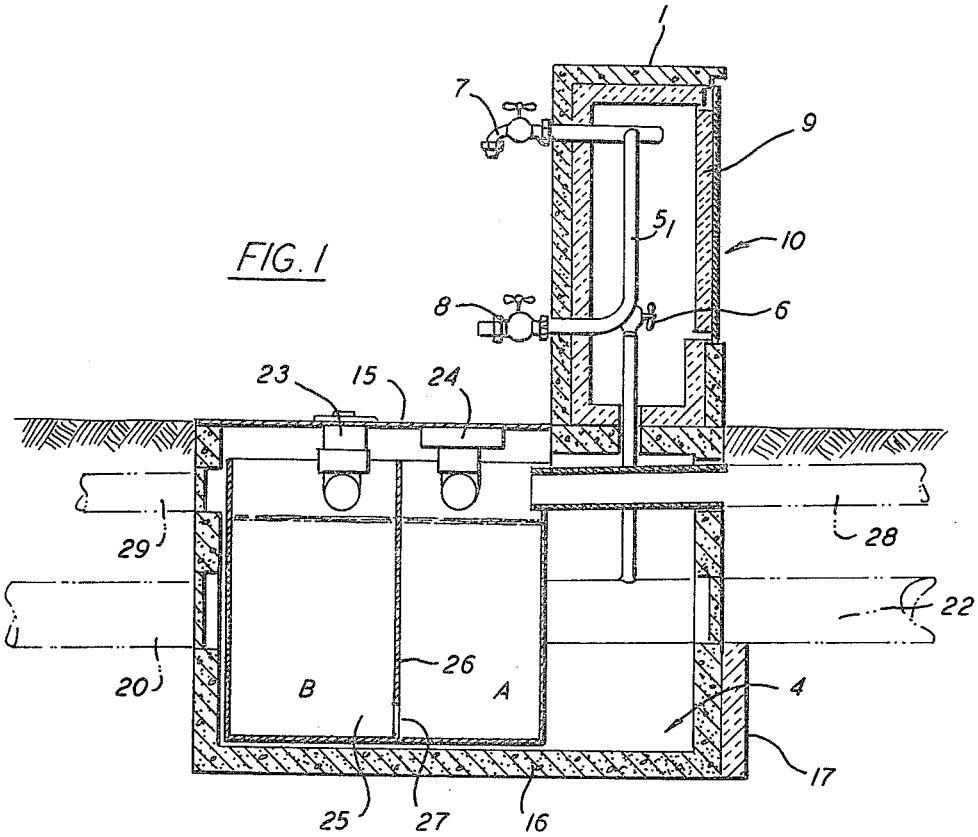
FIG. 1 is a cross-sectional view of the lower and upper compartments of the terminal according to a first embodiment.
Figure 2:
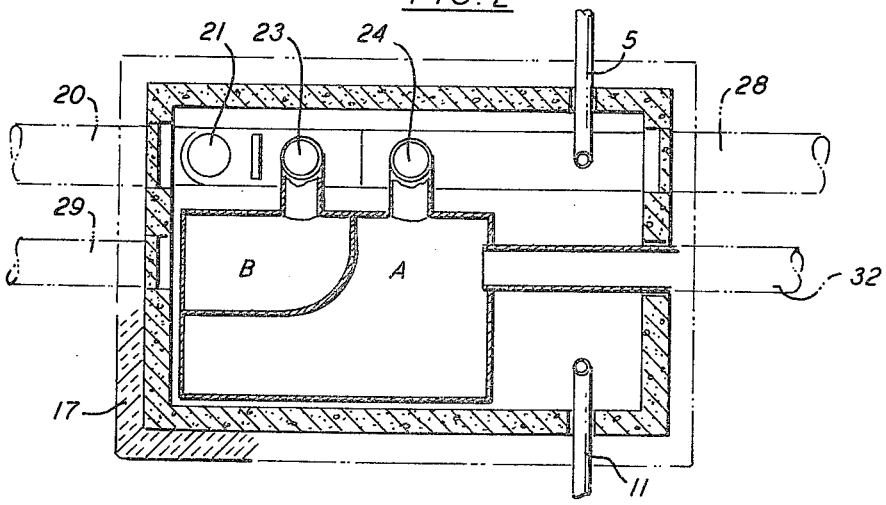
FIG. 2 is a horizontal sectional view of the lower compartment.
Figure 3:
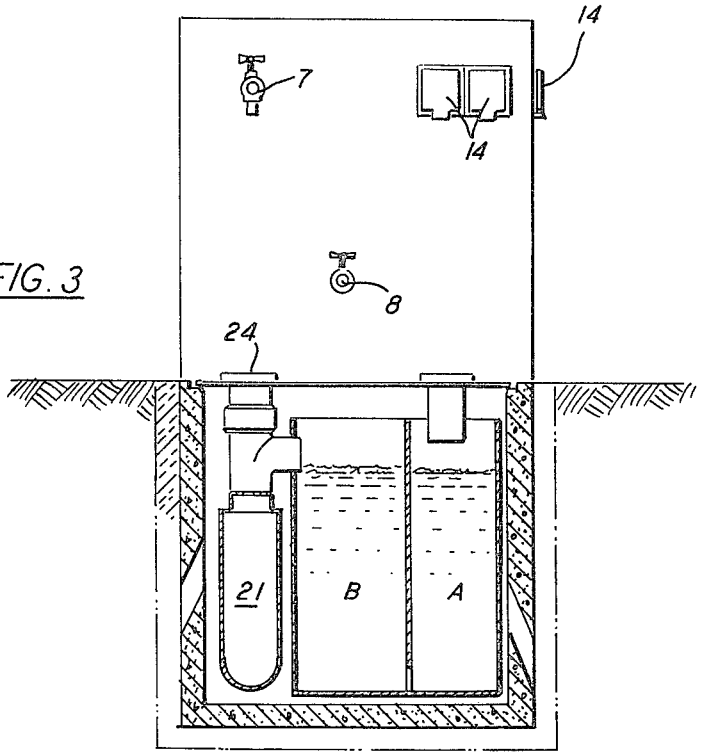
FIG. 3 is a cross-sectional view of the lower compartment.

The service terminal is, as mentioned before, adapted to supply sanitary equipments which are the complements of the equipment of a caravan or a camping-car of conventional type. This terminal mainly comprises two parts or compartments, the upper part grouping the water and electric supplies and optionally the television supply, whereas the lower compartment, adapted to be buried in the ground, groups the means for discharging the household waste liquids and the sewage liquids. This lower compartment may be of two types, namely that shown in FIG. 1 in which the compartment is connected to a purifying station, or that illustrated in FIG. 5 in which the compartment is connected to the public sewage system.

As concerns the first embodiment illustrated in FIGS. 1 to 4, the service terminal mainly comprises a case 1 constituting the upper compartment, this case being shock-resistant so as to permit it to be sealed or embedded in a wall of masonry, said case being divided into two chambers 2 and 3, one of which is for drinking water and the other for the electricity supply. This case is fixed, for example by bolting, to the lower compartment 4 which is also shock-resistant and groups the system for discharging sewage liquids and household waste liquids.

The chamber 2 of the upper compartment supplying drinking water comprises a pipe 5 connected to the water mains, this pipe leading to a stop-cock 6. Beyond this stop-cock, a vertical part $5_1$ enables the water meter (not shown) to be mounted if desired. The pipe $5_1$ terminates, at one end, in an outer tap 7 for drawing off drinking water and, at its other end, in a water take-off 8 having a universal coupling permitting the immediate connection with a fixed or mobile structure. In order to avoid the freezing of the water in wintertime, this chamber is completed by a heat insulator 9 which surrounds it on all sides. Moreover, this chamber has on its rear side an inspection door 10 providing access to in particular the stop-cock 6. Further, this door enables the pipe $5_1$ to be heat-insulated if desired.

Figure 4:
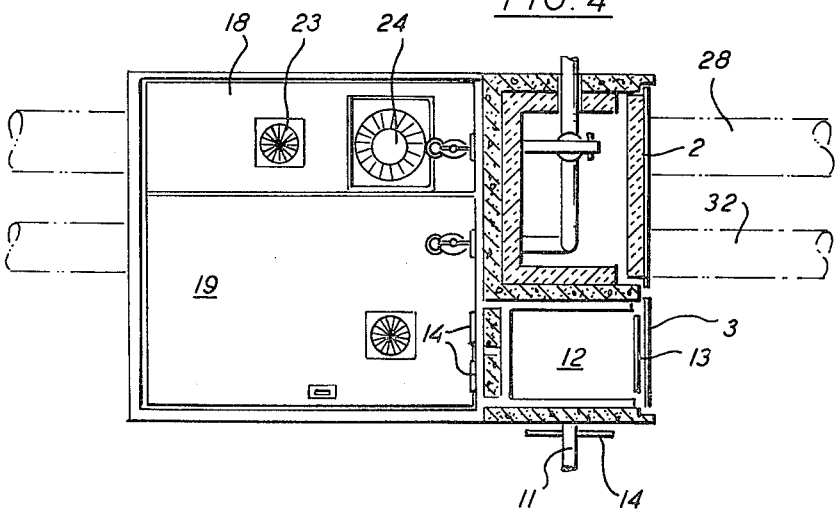
FIG. 4 is a top view of FIG. 1.

The chamber 3 of the upper compartment, as seen in FIG. 4, is also connected to the low-tension mains through a sheathed cable 11 which leads to a connecting box 12 provided with an inspection door 13, this connecting box including a differential circuit breaker and an earth terminal (not shown) and sealed outer current sockets 14. This connecting box 12 may be provided with a television socket connected to a collective aerial.

The lower compartment comprises, as mentioned before, a shock-resistant case and is adapted to be buried in such manner that its upper side 15 is flush with the surface of the ground, this case 16 being surrounded by a heat-insulator 17 so as to avoid the freezing of the pipes which discharge sewage liquids and household waste liquids. This case 16 is closed in the upper part by a semi-fixed cover 18 and a movable cover part 19 (FIG. 4). These covers 18 and 19 are made from a sufficiently strong material so as to resist the passage of the wheels of a vehicle without deforming. In the first embodiment, illustrated in FIGS. 1 to 4, its lower compartment comprises a pipe 20 of suitable diameter and provided with all its accessories and in particular a disconnecting trap 21 (FIG. 3), this trap receiving the sewage liquids of an individual sanitary unit or collective units 22, or the treated liquids from a chemical sanitary device through a coupling 23, or previously degreased household waste liquids to the liquids from a ground stench trap 24. The household liquids are degreased by means of a degreasing tank 25 constructed in the conventional manner from two decanting tanks separated by a wall 26 which defines with the bottom of the tank a passage 27 through which the liquid of the tank A passes into the tank B. The household waste liquids of an individual or collective sanitary unit coming from the pipe 28 pour into the first tank A and then gradually fill the tank B from the bottom after which these degreased liquids are discharged by way of the pipe 20 or by way of a separate system 29.

Figure 5:
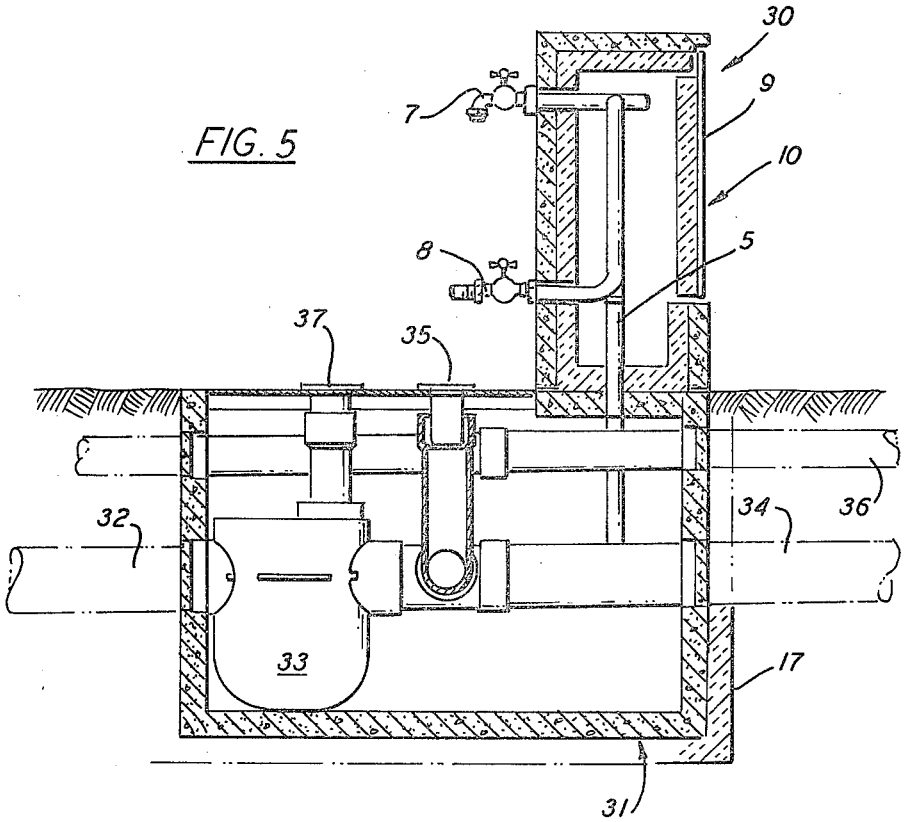
FIG. 5 is a cross-sectional view of the lower and upper compartments of the terminal according to a second embodiment.
Figure 6:
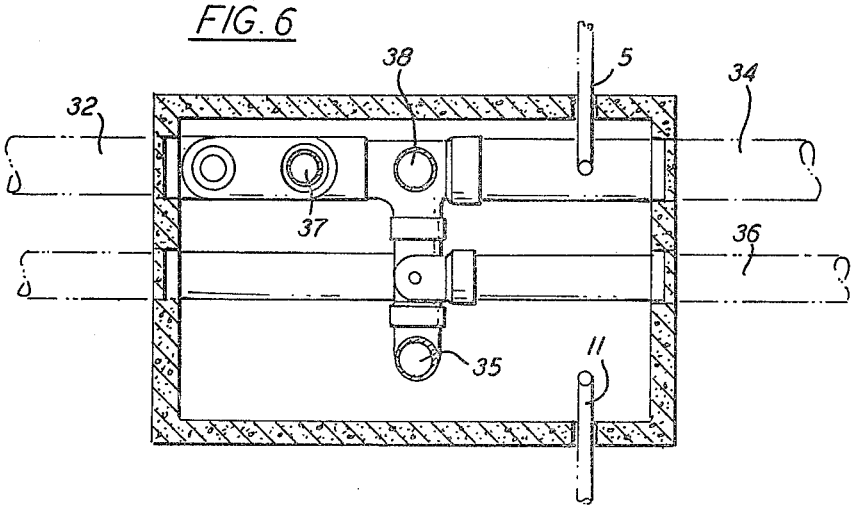
FIG. 6 is a horizontal sectional view of the lower compartment of FIG. 5.
Figure 7:
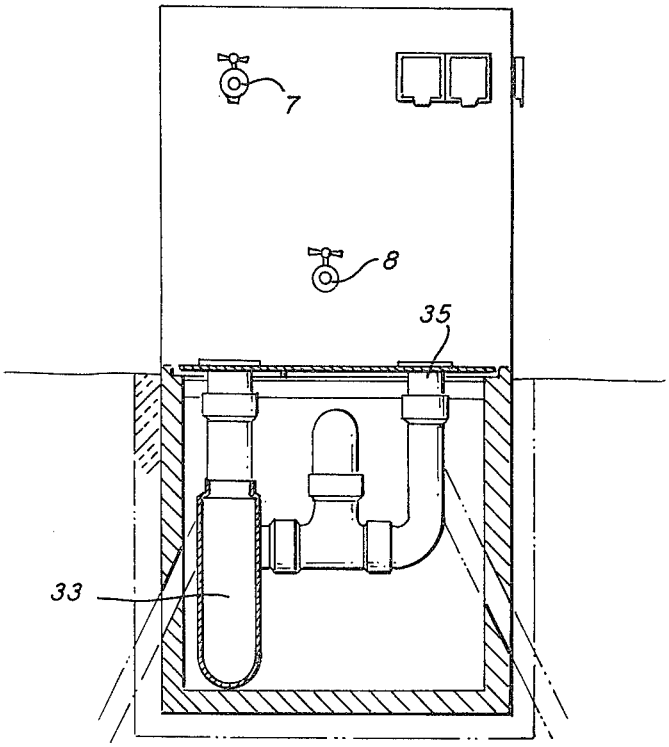
FIG. 7 is a cross-sectional view of the lower compartment of FIG. 6.

In the second embodiment, illustrated in FIGS. 5 to 7, the projecting upper compartment 30 is exactly identical to the compartment 1 of FIG. 1, the constructional difference concerning essentially the equipment of the lower compartment 31. Indeed, in this case, this lower compartment is connected to a main drainage system and comprises a pipe 32 connected to a disconnecting trap 33 which receives the sewage liquids from an individual or collective unit 34, the household waste liquids from a caravan or the like 35, the household waste liquids from an individual or collective unit 36, the treated liquids from a chemical sanitary device 37 and the liquids from a ground trap 38 located under the water tap. All the pipes conveying the sewage liquids 34-36-37 and 35 therefore communicate with a trap 33 which discharges these waste liquids through a large-diameter pipe.

The terminal described hereinbefore, whether it concerns the first embodiment or the second embodiment, is adapted to provide service to fixed or mobile structures and in particular sanitary units which would be complementary to or extend caravans or camping-cars which do not have such a sanitary equipment.

Figure 8:
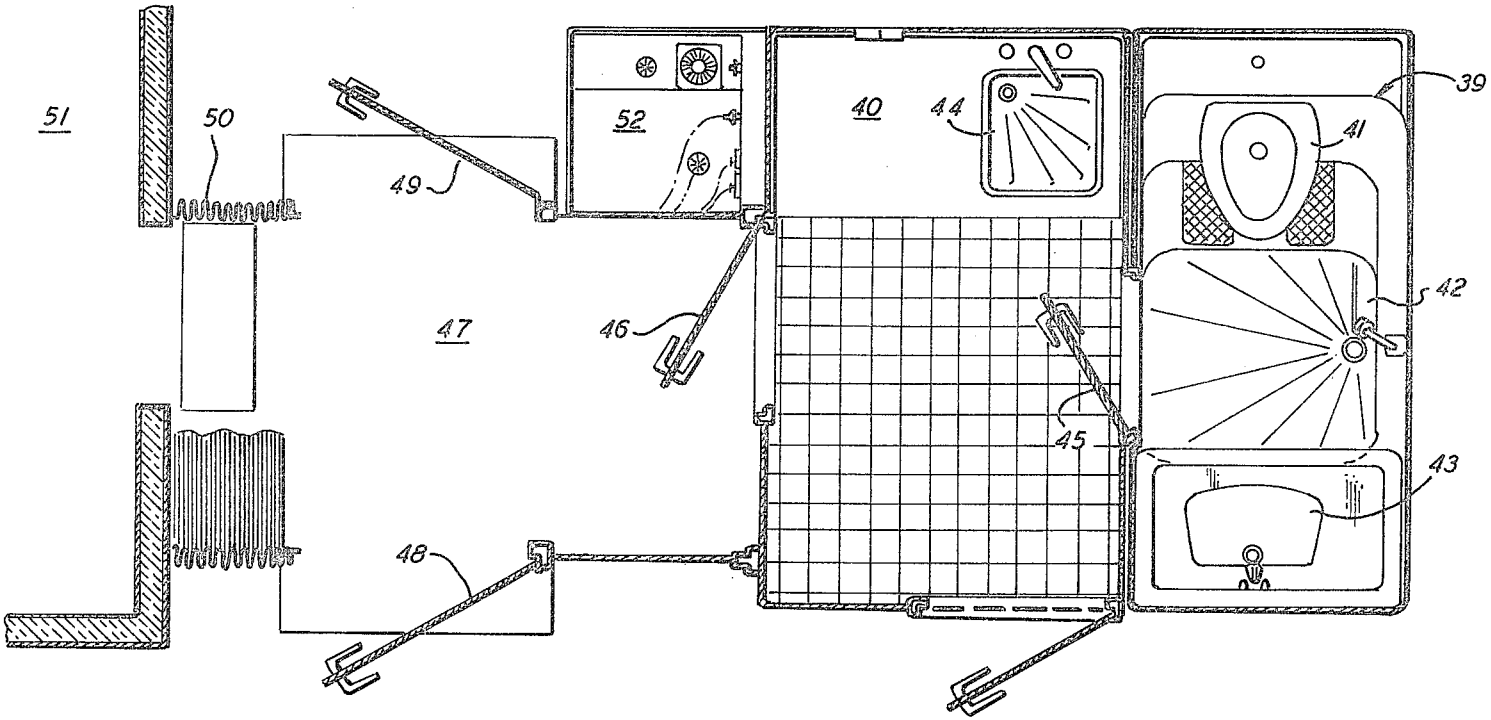
FIG. 8 is a diagrammatic top view of the sanitary unit connected to a caravan or a camping-car.

The example given in FIG. 8 shows a sanitary unit formed by two compartments 39 and 40. The first compartment encloses in a conventional manner a W.C. 41, a shower 42 and a washbasin 43, the second compartment being equipped with a sink and a work table 44 with stowing possibility. A door 45 allows access between the two compartments 39 and 40 and a second door 46 leads to a vestibule 47 which has two doors 48 and 49 in facing relation. In the considered embodiment, the rear side of this sanitary unit has an extensible passageway 50 in the form of a bellows. The latter provides the junction between the sanitary unit and the rear part of a fixed or mobile dwelling, for example the lateral or rear side of a caravan 51 or camping-car. The supplies and the discharging means of the various apparatus of this sanitary unit are connected to the service terminal 52 which is in every way comparable to those illustrated to FIGS. 1 to 7, it being possible to insert the upper part of this terminal, i.e. the projecting part of this L-shaped terminal under the sink 40 as shown in FIG. 9, or behind the seat of the W.C. or to place it against the sanitary unit.

Hot water may be supplied by a simple electric accumulator or by an electric accumulator coupled with a solar captor; the heating is ensured by electric apparatus.

Figure 9:
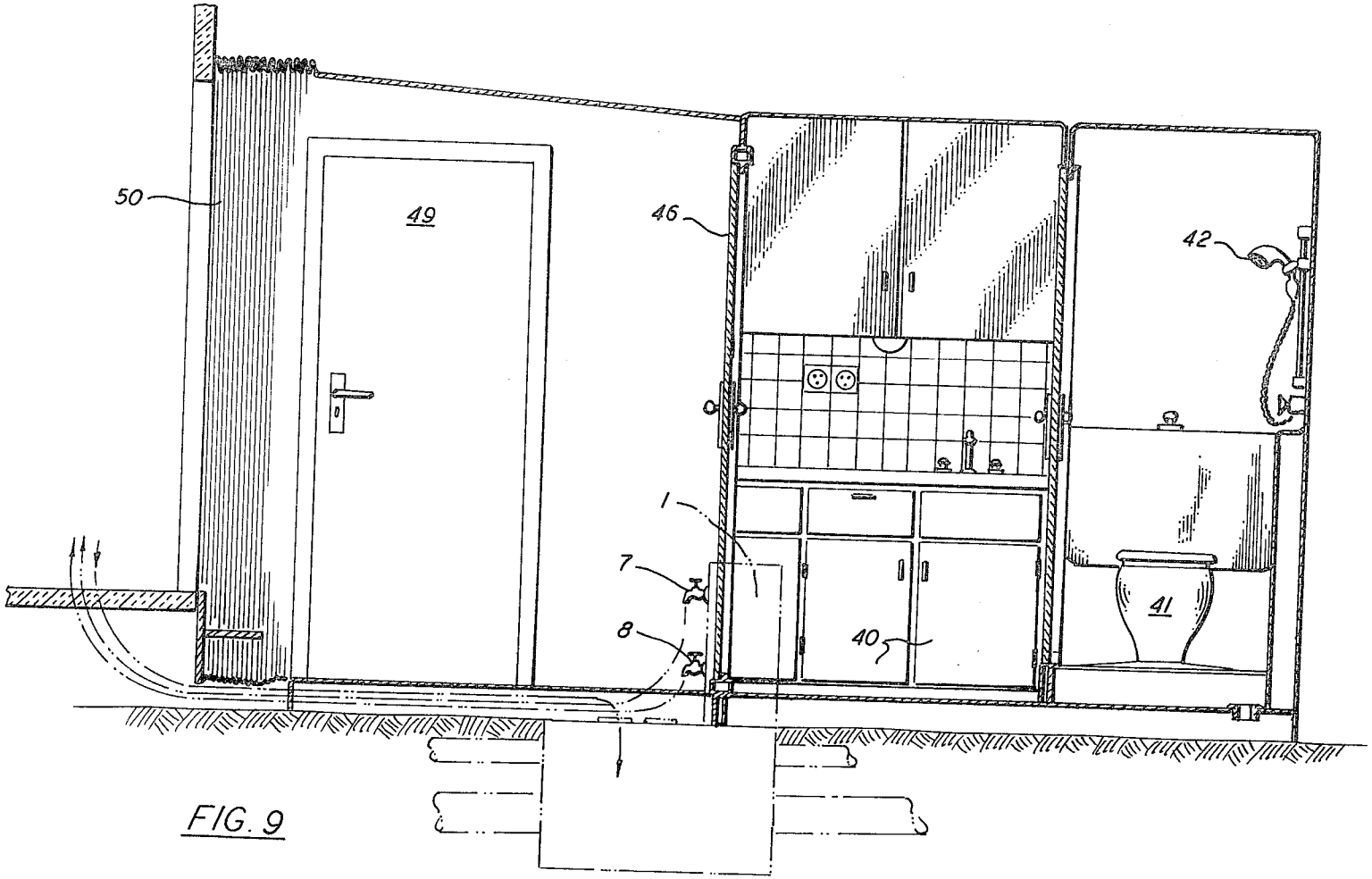
FIG. 9 is a side elevational view of FIG. 8.

The sanitary units such as illustrated in FIGS. 8 and 9 may be grouped so as to constitute a sanitary installation of large capacity and its various units may be made from various materials or may be covered or clad so as to permit the perfect insertion thereof on the site and their adaptation to local conditions.

Indeed, it must be understood that the terminal may provide service to fixed structures other than the sanitary unit illustrated in FIGS. 8 and 9 and that this unit may operate alone as a sanitary installation of a building site or a holiday camp without being connected to a caravan or a camping-car, this unit being in this case merely coupled to the terminal which ensures the supply and the discharge of waste liquids.

Consequently, the invention encompasses individually the service terminal and the sanitary unit and, in combination, this terminal and this unit associated with a mobile dwelling such as a caravan or camping-car.

We claim:

1. A junction and connection terminal for partly embedding in the ground and comprising a case which is of strong material and has an upper part which projects from the surface, the ground and a lower main part which is buried in the ground and has an upper wall substantially flush with the surface of the ground, said upper part defining a first compartment and a second compartment and said lower part defining a third compartment, drinking water piping within said first compartment and leading out of said first compartment for connection to drinking water mains supply, tap means outside said upper part of said case and connected to said piping and supported by said upper part, said tap means including rapid pipe coupling means for connecting said tap means to piping a fixed or mobile sanitary unit for supplying drinking water thereto, electric mains supply cables extending into said second compartment, electric socket means located outside, and mounted on said upper part of said case, for plugging in electric cables of said fixed or mobile sanitary unit, an electric junction box within said second compartment and connecting said mains supply cables to said electric socket means, sewage and household waste liquids discharge pipe means extending out of the interior of said third compartment, sewage and household waste liquids, inlet pipe means extending into said third compartment, means located inside said third compartment and connecting said sewage and household waste liquids inlet pipe means to said sewage and household waste liquids, discharge means and pipe coupling means located outside said third compartment and provided on said sewage and household waste liquids inlet pipe means for connecting said inlet pipe means to sewage and household waste liquids, outlet pipe means of said fixed or mobile sanitary unit.

2. A terminal as claimed in claim 1, wherein the two parts of the case thereof are enclosed in a covering providing a good heat insulation and are in superimposed and fixed relation to each other.

3. A terminal as claimed in claim 1, wherein the two compartments have a substantially parallel-sided shape and constitute an L-shape assembly having an horizontal branch which is buried in the ground and a vertical branch which projects from the ground and is fixed to the horizontal branch.

4. A terminal as claimed in claim 1, wherein said third compartment comprises two separate systems for respectively discharging sewage and household waste liquids, a first of said systems comprising a sewage conduit, a first pipe connected to the sewage conduit with interposition of a disconnecting trap, the second system comprising a household waste liquids conduit, and a second pipe connected to the household waste liquids conduit, with interposition of a degreasing tank.

5. A terminal as claimed in claim 4, wherein a ground trap is interposed between the first pipe and the sewage conduit.

6. A terminal as claimed in claim 4, wherein the degreasing tank is connected to the first pipe.

7. A terminal as claimed in claim 4, wherein the upper side of the buried part comprises a coupling connected to the first pipe for connecting the first pipe to a chemical sanitary device provided in the sanitary unit.

8. A terminal as claimed in claim 1, wherein the lower compartment comprises a single system for discharging sewage and household waste liquids which comprises a sewage conduit, a pipe connected to a sewage conduit and a coupling for treated liquids of a chemical sanitary device and connected to the last-mentioned pipe, and a disconnecting trap which is located on the down-stream side of zones of connections of said various conduits for receiving sewage and said liquids.

9. A terminal as claimed in claim 1, wherein said tap means comprising a tap for drawing off water directly from the terminals and a water take-off tap with a universal coupling for coupling to a pipe leading to the sanitary unit and stop-cock means provided on said drinking water a piping, an inspection door located on a side of said first compartment opposed to said tap means and permitting access to the stop-cock means from outside the terminal.

10. A terminal as claimed in claim 9 wherein the electric mains is of low-tension and the electric sockets are watertight.

11. In a camping ground, in combination, a plurality of junction and connection terminals embedded in but projecting from the ground;

a plurality of mobile dwellings;

a plurality of mobile sanitary units, each of which sanitary units is optionally interposable between a selected one of said terminals and a selected one of said mobile dwellings, when said selected one of said dwellings is insufficiently or unsuitably equipped with washing and W.C. facilities for a prolonged stay on said camping ground, each of said terminals comprising a case which is of strong material and has an upper part which projects from the surface of the ground and a lower main part which is buried in the ground and has an upper wall substantially flush with the surface of the ground, said upper part defining a first compartment and a second compartment and said lower part defining a third compartment, drinking water piping within said first compartment and leading out of said first compartment and connected to drinking water mains supply of the camping ground, tap means outside said upper part of said case and connected to said piping and supported by said upper part, said tap means including rapid pipe coupling means, electric mains supply cables extending into said second compartment, electric socket means located outside and mounted on said upper part of said case, an electric junction box within said second compartment and connecting said mains supply cables to said electric socket means, sewage and household waste liquids discharge pipe means extending out of the interior of said third compartment, sewage and household waste liquids inlet pipe means extending into said third compartment, means located inside said third compartment and connecting said sewage and household waste liquids inlet pipe means to said sewage and household waste liquids discharge means and pipe coupling means located outside said third compartment and provided on said sewage and household waste liquids inlet pipe means, each sanitary unit comprising an enclosure equipment including a W.C. and washing means disposed in said enclosure, means defining a door and optionally means defining a passageway for putting the interior of said enclosure in communication with the interior of said dwelling by way of said door and a door of said dwelling, drinking water inlet piping for said washing means and said W.C., rapid pipe coupling means for coupling to said rapid pipe coupling means of said taps of said terminal, household waste liquid and sewage discharge pipe means leading from said washing means and said W.C., coupling means for connecting said discharge pipe means of said sanitary unit to said coupling means of said household waste liquid and sewage inlet pipe means of said terminal, and electric equipment having cables provided with plugs extending outside the unit for connection to said socket means of said terminal;

said terminal comprising coupling means on said upper wall of said lower part of the terminal for connecting household waste liquid and/or W.C. discharge pipe means of said mobile dwelling pipe means of said terminal to said household waste liquid and sewage discharge in the event that said dwelling is connected directly to said terminal without interposition of said sanitary unit.

12. The combination as claimed in claim 11 wherein the dwelling is a caravan.

13. The combination as claimed in claim 11 wherein the dwelling is a mobile house.

14. The combination as claimed in claim 11, wherein the dwelling is a camping-car.

15. The combination of claim 11, wherein said sanitary unit defines a second enclosure containing a kitchenette with a sink also connectable with said terminal by way of said household waste liquid discharge piping of said unit and also electrically connectable with said plug sockets of said terminal.

* * * * *

UNITED STATES PATENT AND TRADEMARK OFFICE

CERTIFICATE OF CORRECTION

PATENT NO. : 4,332,681

DATED : June 1, 1982

INVENTOR(S) : Jambry et al.

It is certified that error appears in the above—identified patent and that said Letters Patent is hereby corrected as shown below:

Column 5, line 4, (claim 3, line 2) "compartments" should read --parts of the case--.

Column 5, line 5, (claim 3, line 3) "an" should read --a--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*